US005228171A

United States Patent [19]

Leifeld

[11] Patent Number: 5,228,171

[45] Date of Patent: Jul. 20, 1993

[54] APPARATUS FOR FEEDING FIBER TUFTS TO A FIBER PROCESSING MACHINE

[75] Inventor: Ferdinand Leifeld, Kempen, Fed. Rep. of Germany

[73] Assignee: Trützschler GmbH & Co KG, Mönchengladbach, Fed. Rep. of Germany

[21] Appl. No.: 644,536

[22] Filed: Jan. 23, 1991

[30] Foreign Application Priority Data

Jan. 23, 1990 [DE] Fed. Rep. of Germany ..... 4001817
Dec. 6, 1990 [DE] Fed. Rep. of Germany ..... 4038838

[51] Int. Cl.[5] ..... D01G 15/40
[52] U.S. Cl. ..... 19/105; 19/204
[58] Field of Search ..... 19/97.5, 105, 145.7, 19/204, 205, 296

[56] References Cited

U.S. PATENT DOCUMENTS

| | | | |
|---|---|---|---|
| 3,070,847 | 1/1963 | Schwab | 19/105 |
| 4,030,635 | 6/1977 | Hablutzel et al. | 19/105 |
| 4,176,988 | 12/1979 | Lattmann et al. | 19/105 |
| 4,403,374 | 9/1983 | Wood | 19/105 |
| 4,539,728 | 9/1985 | Portell . | |
| 4,657,444 | 4/1987 | Pinto | 19/105 |
| 4,776,066 | 10/1988 | Leifeld | 19/105 |
| 4,779,311 | 10/1988 | Leifeld | 19/105 |
| 4,878,784 | 11/1989 | Binder et al. | 19/105 |
| 4,939,815 | 7/1990 | Leifeld | 19/105 |

FOREIGN PATENT DOCUMENTS

| | | | |
|---|---|---|---|
| 3733631 | 4/1989 | Fed. Rep. of Germany | 19/105 |
| 3734140 | 4/1989 | Fed. Rep. of Germany | 19/105 |
| 835215 | 5/1960 | United Kingdom . | |
| 1375552 | 11/1974 | United Kingdom . | |
| 1477520 | 6/1977 | United Kingdom . | |
| 2001366 | 1/1979 | United Kingdom . | |
| 2210643 | 4/1989 | United Kingdom . | |

*Primary Examiner*—Clifford D. Crowder
*Assistant Examiner*—Michael A. Neas
*Attorney, Agent, or Firm*—Spencer, Frank & Schneider

[57] ABSTRACT

A fiber tuft feeder includes a reserve chute; a feed roll supported in the reserve chute at an outlet thereof; a countersupport cooperating with the feed roll for defining therewith a nip through which the feed roll draws fiber tufts from the reserve chute; an opening roll supported immediately downstream of the nip for receiving fiber tufts from the nip; and a feed chute having an inlet connected to the outlet of the reserve chute. A relative motion of the feed roll and the countersupport toward and away from one another is permitted for varying the distance between the feed roll and the countersupport by the fiber tufts passing therebetween. Further, a spring is provided which resiliently urges the feed roll and the countersupport towards one another.

14 Claims, 3 Drawing Sheets

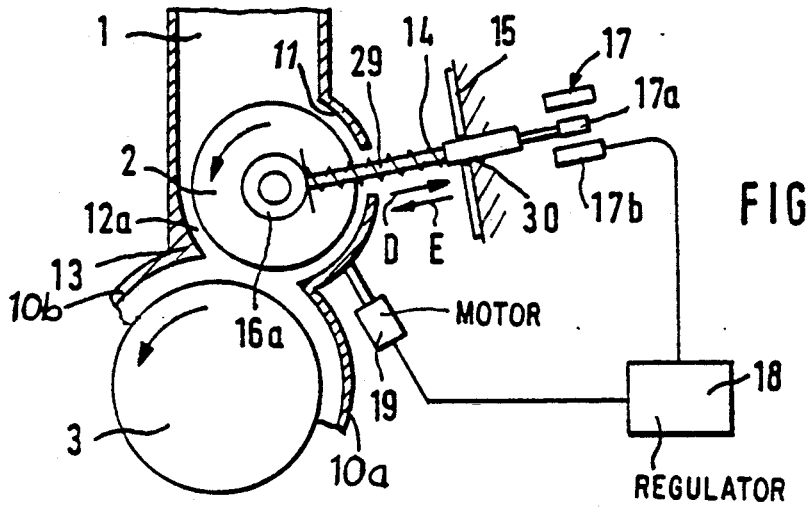
FIG. 2
FIG. 3
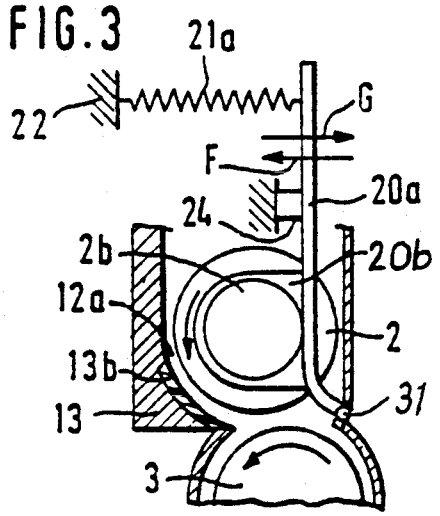
FIG. 4
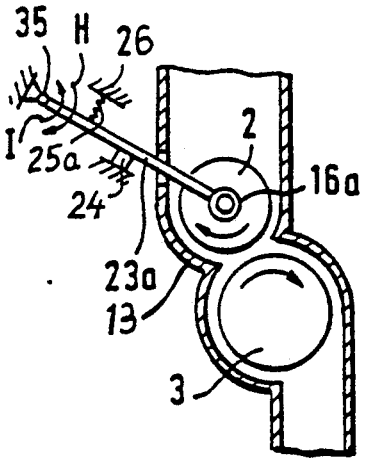
FIG. 5
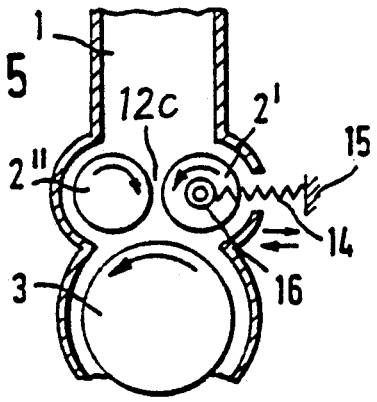
FIG. 6
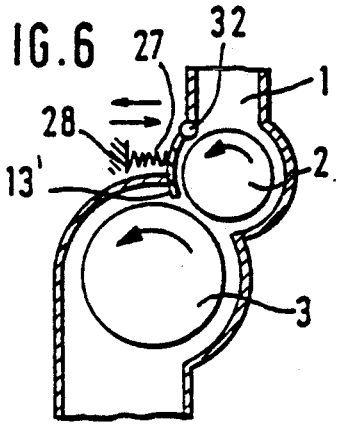

29
15a
2
3
14b
33
34

APPARATUS FOR FEEDING FIBER TUFTS TO A FIBER PROCESSING MACHINE

CROSS REFERENCE TO RELATED APPLICATION

This application claims the priority of Federal Republic of Germany Application No. P 40 01 817.2 filed Jan. 23, 1990, which is incorporated herein by reference.

BACKGROUND OF THE INVENTION

This invention relates to an apparatus for feeding fiber tufts such as cotton or chemical fiber tufts to a fiber processing machine such as a card, a roller card unit, a cleaner or the like.

The apparatus has a reserve chute chargeable with fiber tufts, a take-in mechanism such as a slowly rotating feed roll, a countersupport cooperating with the feed roll for forming a nip to advance the fiber material therebetween, an opening device, such as a rapidly rotating opening roll arranged immediately downstream of the feed roll and a feed chute which receives the fiber material from the feed roll and the opening roll.

In a known device where the gap defined by the feed roll and the countersupport is constant (for example, 5 mm), only a predetermined fiber flow rate, for example, 360 kg/h per m width may be achieved. Further, upon changes in the type of the fiber material and the behavior of the fiber, problems are often encountered concerning the clamping in the nip defined by the feed roll and the countersupport, since the clamping behavior differs dependent upon the hardness or softness of the fiber material.

SUMMARY OF THE INVENTION

It is an object of the invention to provide an improved apparatus of the above-outlined type from which the discussed disadvantages are eliminated and which, in particular, achieves an alteration of the fiber material quantity passing through the nip defined by the feed roll and the countersupport and, at the same time ensures a secure clamping of the fiber material.

This object and others to become apparent as the specification progresses, are accomplished by the invention, according to which, briefly stated, the fiber tuft feeder includes a reserve chute; a feed roll supported in the reserve chute at an outlet thereof; a countersupport cooperating with the feed roll for defining therewith a nip through which the feed roll draws fiber tufts from the reserve chute; an opening roll supported immediately downstream of the nip for receiving fiber tufts from the nip; and a feed chute having an inlet connected to the outlet of the reserve chute. A relative motion of the feed roll and the countersupport toward and away from one another is permitted for varying the distance between the feed roll and the countersupport by the fiber tufts passing therebetween. Further, a spring is provided which resiliently urges the feed roll and the countersupport towards one another.

By virtue of the invention which thus provides for a spring-biased relative displacement of the feed roll and the countersupport towards or away from one another, there is achieved an automatic alteration of the intake gap (nip), making possible, for example, a larger throughput, such as, for example, 500 kg/h per m width or more. It is a further advantage of the invention that for each type of material the feed roll securely clamps the fiber material against the countersupport, that is, a more uniform throughput of material is effected. A manual adjustment or re-adjustment of the feed roll may thus be dispensed with. It is a further advantage of the invention that the displacements of, for example, the feed roll may be utilized as a measuring magnitude for a regulated setting member.

BRIEF DESCRIPTION OF THE DRAWING

FIGS. 2–6 are schematic side elevational views of five additional preferred embodiments of the invention.

DESCRIPTION OF THE PREFERRED EMBODIMENTS

Figure 1A:
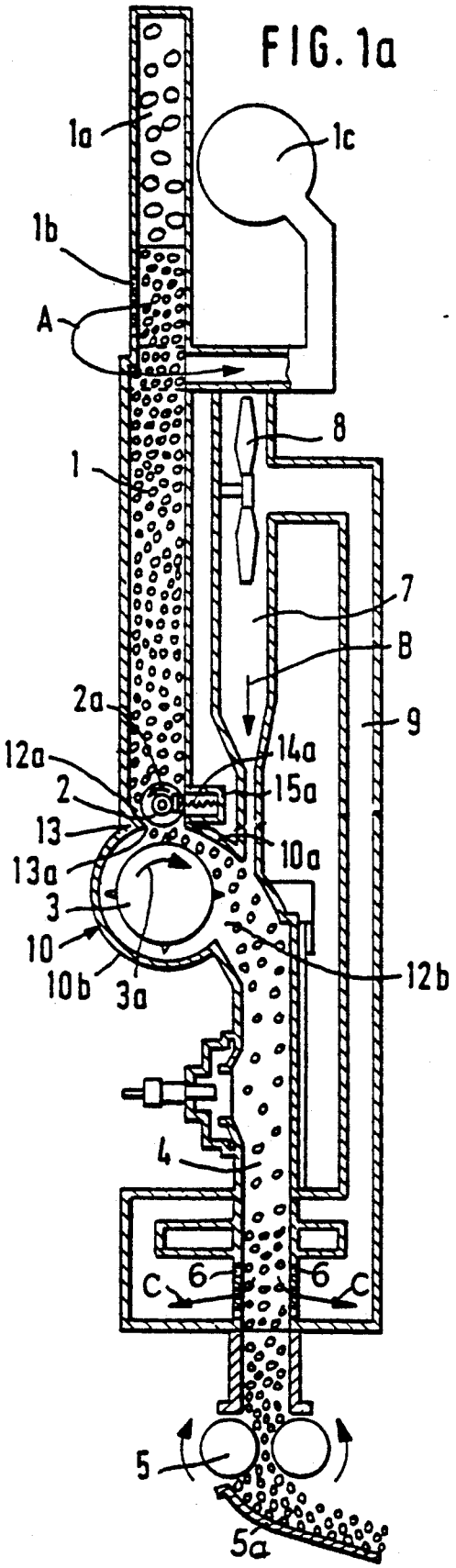
FIG. 1*a* is a schematic side elevational view of a tuft feeder incorporating a preferred embodiment of the invention.

Turning to FIG. 1*a*, there is illustrated therein a tuft feeder adapted for use to advance a fiber lap to a carding machine. The tuft feeder which may be of a general construction corresponding to an EXACTAFEED FBK model, manufactured by Trützschler GmbH & Co. KG, Mönchengladbach, Germany, has a vertically oriented reserve chute 1 which is charged with fiber tuft from above, for example, from an overhead distributor duct 1*a* after the material has passed through a condenser (not shown). In an upper zone of the reserve chute 1 air outlet openings 1*b* are provided through which the conveying air stream passes after separation of the fiber tufts and enters a suction device 1*c* as indicated by the arrow A.

The lower end of the reserve chute 1 is obturated by a feed roll 2 which rotates counterclockwise as indicated by the arrow 2*a* and which cooperates with a fixed feed lip 13. The feed roll 2 and the feed lip 13 together define a nip (fiber guiding channel) 12*a*. Immediately downstream of the fiber guiding channel 12*a*—as viewed in the direction of fiber advance—there is arranged an opening roll 3 which rotates clockwise as indicated by the arrow 3*a* and which may have pins or a sawtooth clothing on its surface. One part of the circumferential surface of the opening roll 3 bounds an upper, intake end of a feed chute 4. The opening roll 3 advances the fiber material into the feed chute 4. The feed lip 13 has a terminal edge 13*a* oriented in the direction of rotation of the adjacent portions of the feed roll 3.

The feed chute 4 has at its lower end two cooperating delivery rolls 5 which rotate as designated by the respective arrow and which withdraw the fiber material from the feed chute 4 and advance the same as a fiber lap on a feed tray 5*a* to the non-illustrated carding machine.

The walls of the feed chute 4 are, along a length portion in the lower part thereof, provided with air outlet openings 6. The upper end of the feed chute 4 communicates with a duct 7 whose upper end adjoins the pressure side of a blower 8. The rotating feed roll 2, in cooperation with the feed lip 13, and the opening roll 3 continuously deliver, at a determined flow rate, fiber material into the feed chute 4 and, at a similar flow rate, fiber quantities are withdrawn by the delivery rolls 5 from the feed chute 4 and deposited on the feed tray 5*a*.

To uniformly densify and to maintain constant the fiber quantities, the blower 8 generates a compressing air stream B which is directed downwardly into the feed chute 4. The blower 8 draws air from a suction channel 9 whose lower end communicates the air outlet openings 6 provided in the feed chute 4 and drives compressed air down through the duct 7 through the fiber column in the feed chute 4 and out of the air outlet openings 6 as indicated by the arrows C.

The opening roll 3 is surrounded by a housing 10 formed of two arcuate wall portions 10*a* and 10*b* while the feed roll 2 is surrounded by a wall 11, as shown in FIG. 2. The wall 11 as well as the wall portions 10*a*, 10*b* conform to the curvature of the feed roll 2*a* and the opening roll 3, respectively. The housing portions 10*a* and 10*b* are separated from one another by a clearance 12*b* which forms the upper, intake end of the feed chute 4 and through which thus the fiber material is advanced into the feed chute 4 by the opening roll 3. The densifying air flow B proceeds codirectionally with the rotation of the adjoining circumferential portion of the opening roll 3.

Figure 1B:
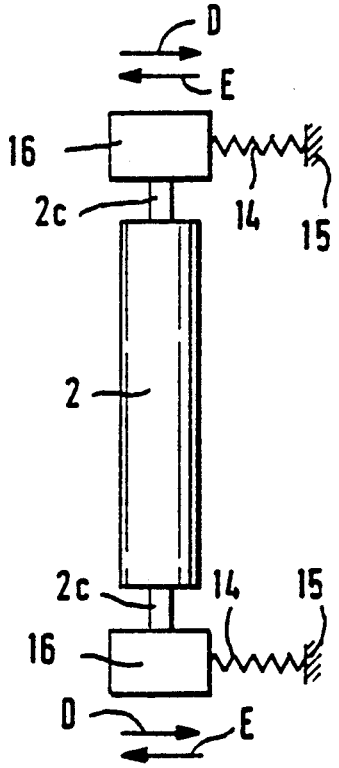
FIG. 1*b* is a top plan view of a component of the construction shown in FIG. 1*a*.

As shown in FIG. 1*b*, the opposite stub shafts 2*c* of the feed roll 2 are supported in respective rotary bearings 16 supported with the intermediary of respective compression springs 14 at two fixed surfaces 15 which form part of the walls of the reserve chute 1.

Reverting once again to FIG. 2, each rotary bearing 16 is held on the respective support 15 by means of a bar 29 which is surrounded by a compression spring 14 and which passes through an opening 30 provided in the support 15. At the end of the bar 29, remote from the rotary bearing 16, there is a plunger armature 17*a* which cooperates with a solenoid 17*b*. The assembly 17*a*, 17*b* forms an inductive path sensor 17 which is connected with a regulatable drive motor 19 for the feed roll 2 with the intermediary of a regulator 18. If, for example, the fiber quantity passing through the nip 12*a* increases, the feed roll 2 is radially displaced in the direction of the arrow D whereupon the compression spring 14 exerts a counterforce in the direction of the arrow E. The counterforce is thus applied to the feed roll 2 which then firmly clamps the fiber material against the feed lip 13 thus preventing the opening roll 3 from tearing an entire batch of fibers from the outlet side of the nip 12*a*. In this arrangement both the feed roll 2 and the opening roll 3 rotate in the same sense in a counter-clockwise direction.

Turning to FIG. 3, in the embodiment shown therein there is provided a lever arm 20*a*, one end of which is held in a stationary pivotal support 31. The lever arm 20*a* is thus able to execute swinging motions thereabout towards or away from the feed lip 13 as indicated by the arrows F, G. The other end of the lever arm 20*a* is connected by means of a tension spring 21*a* with a stationary support 22. The lever arm 20*a* supports a bearing bracket 20*b* which holds the stub shaft 2*b* of the feed roll 2. Further, the mid zone of the lever arm 20*a* engages a stationary abutment 24, thereby ensuring a minimum clearance for the fiber guiding channel (nip) 12*a*. Advantageously, the feed lip 13 is provided, on its surface oriented towards the feed roll 2, with a low-friction coating 13*b*, such as a Teflon layer.

Turning to the embodiment illustrated in FIG. 4, there is provided a lever arm 23*a* which is at one end articulated to a stationary pivot 35. At the opposite end the lever arm 23*a* carries the rotary bearing 16*a* of the feed roll 2. The lever arm 23*a* is, by means of a compression spring 25*a*, held on a stationary support 26, biased against a stationary abutment 24. The lever arm 23*a* is pivotal in the direction of the arrows I, H.

Turning to the embodiment illustrated in FIG. 5, there are provided two feed rolls 2' and 2''. The feed roll 2'' is stationarily supported and constitutes a countersupport for the feed roll 2' to define a nip 12*c* therewith. The rotary bearing 16 of the feed roll 2' is movably supported by means of the compression spring 14 on a stationary support 15 for excursions radially towards or away from the feed roll 2''.

Turning now to the embodiment illustrated in FIG. 6, the feed roll 2 is stationarily supported and cooperates with a feed lip 13' which is pivotally secured at one end at 32. A compression spring 27 is, with one end, in engagement with a stationary support 28 and presses, with its other end, the feed lip 13' towards the feed roll 2.

Figure 7:
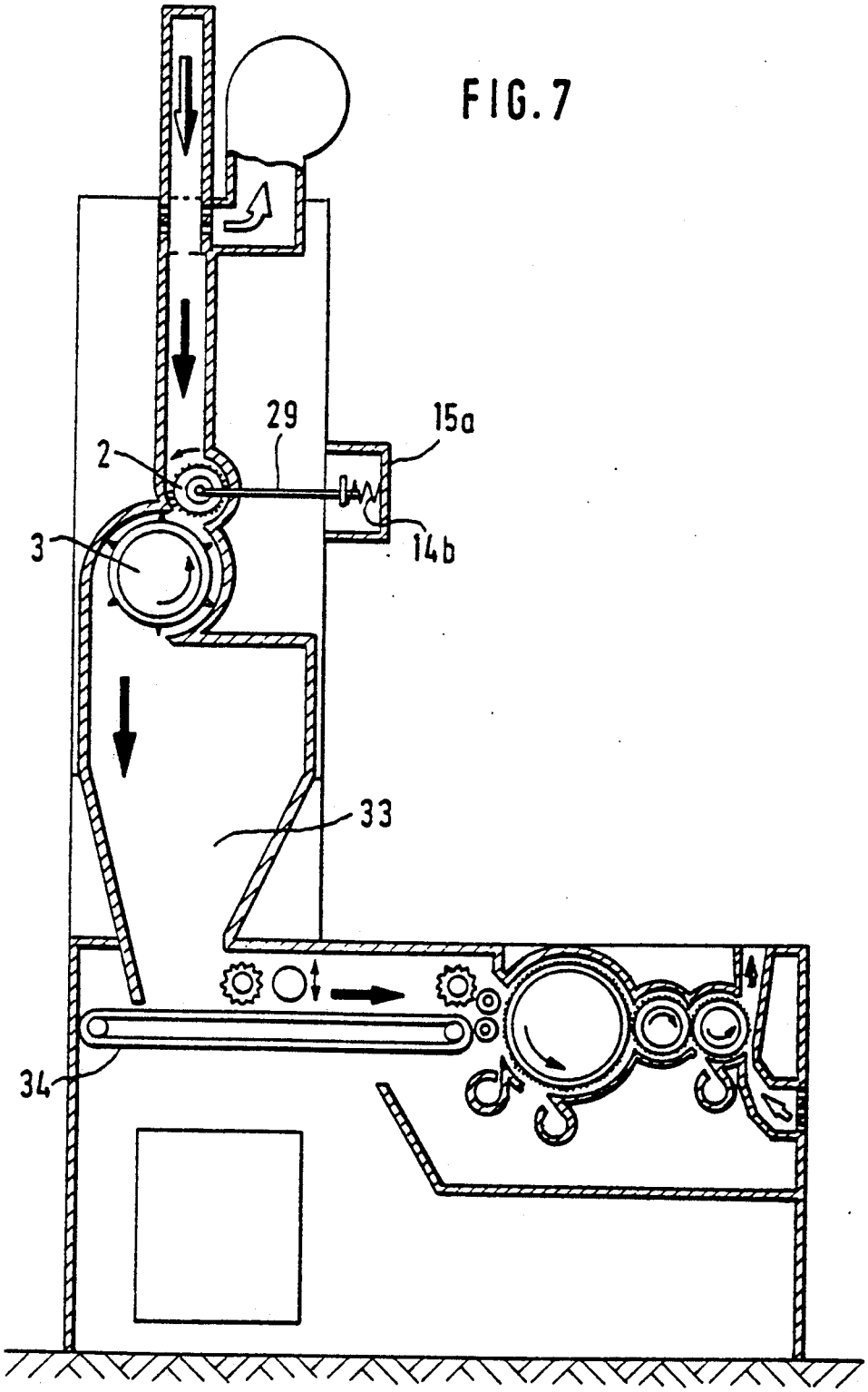
FIG. 7 is a schematic side elevational view of a tuft feeder different from that shown in FIG. 1*a* and incorporating the preferred embodiment of FIGS. 1*a* and 1*b*.

FIG. 7 shows a fiber feeder in which the fiber tufts fall from the opening roll 3 onto a conveyor belt 34 to form a deposited layer thereon. The feed roll 2 is movably supported similarly to the embodiment described in connection with FIG. 1*a*. Between the opening roll 3 and the conveyor belt 30 the fiber tufts are in a free fall through a feed chute, such as a space 33 without pneumatic densification as it was the case in the construction described in connection with FIG. 1*a*.

It will be understood that the above description of the present invention is susceptible to various modifications, changes and adaptations, and the same are intended to be comprehended within the meaning and range of equivalents of the appended claims.

What is claimed is:

1. A fiber tuft feeder comprising:

(a) a reserve chute having an outlet;

(b) a feed roller supported in the reserve chute at the outlet thereof;

(c) a feed lip cooperating with the feed roll for defining therewith a nip through which the feed roll draws fiber tufts from the reserve chute; said feed lip having a surface oriented towards the feed roll and having a curvature generally parallel to a circumferential curvature of the feed roll to define for said nip a predetermined length as viewed in a direction of passage of the fiber tufts;

(d) an opening roll supported immediately downstream of the nip as viewed in said direction of passage; said opening roll being arranged for receiving fiber tufts from said nip;

(e) a feed chute having an inlet connected to the outlet of the reserve chute; said feed chute being arranged for receiving fiber tufts from said opening roll; said feed chute further having an outlet for discharging fiber tufts from said feed chute;

(f) means for permitting a relative motion of the feed roll and the feed lip toward and away from one another for varying the distance between the feed roll and the feed lip by the fiber tufts passing therebetween; said means for permitting a relative motion further comprising a stationary stop means for limiting said relative motion for setting a minimum width for said nip; and (g) spring means for resiliently urging said feed roll and said feed lip towards one another.

2. A fiber tuft feeder as defined in claim 1, wherein said feed roll is stationarily supported; said means for permitting a relative motion comprises means for movably supporting said feed lip; said spring means being operatively connected with said feed lip for resiliently urging said feed lip toward said feed roll.

3. A fiber tuft feeder as defined in claim 1, further comprising a conveyor belt arranged at the outlet of the feed chute for receiving the fiber tufts falling freely from said opening roll.

4. A fiber tuft feeder as defined in claim 1, wherein said feed lip is stationarily affixed to said reserve chute and further wherein said means for permitting a relative motion comprises means for movably supporting said feed roll.

5. A fiber tuft feeder as defined in claim 4, wherein said spring means comprises a compression spring operatively connected with said feed roll for resiliently urging said feed roll towards the stationary feed lip.

6. A fiber tuft feeder as defined in claim 4, wherein said spring means comprises a tension spring operatively connected with said feed roll for resiliently urging said feed roll towards the stationary feed lip.

7. A fiber tuft feeder as defined in claim 4, further comprising a stationary spring support abutted by said spring means.

8. A fiber tuft feeder as defined in claim 4, wherein said means for permitting relative motion comprises a movable rotary bearing supporting said feed roll; said spring means being connected to said rotary bearing.

9. A fiber tuft feeder as defined in claim 4, further comprising a path sensor connected to said feed roll for sensing displacement of the feed roll towards and away from said stationary feed lip.

10. A fiber tuft feeder as defined in claim 9, wherein said path sensor is an inductive path sensor.

11. A fiber tuft feeder as defined in claim 9, further comprising a regulator having an input and an output; said path sensor being connected to said input; and a speed-variable motor driving said feed roll; said motor being connected to said output of said regulator for changing the speed of said motor as a function of the displacement of said feed roll.

12. In a fiber tuft feeder including a reserve chute having an outlet;

a feed roll supported in the reserve chute at the outlet thereof;

a feed lip stationarily affixed to said reserve chute and cooperating with the feed roll for defining therewith a nip through which the feed roll draws fiber tufts from the reserve chute;

an opening roll supported immediately downstream of the nip as viewed in a direction of passage of the fiber tufts through the nip; said opening roll being arranged for receiving fiber tufts from said nip; and a feed chute having an inlet connected to the outlet of the reserve chute; said feed chute being arranged for receiving fiber tufts from said opening roll; said feed chute further having an outlet for discharging fiber tufts from said feed chute;

the improvement comprising (a) means for movably supporting said feed roll for displacements toward and away from said feed lip for varying the distance between the feed roll and the feed lip by the fiber tufts passing therebetween; said means for movably supporting said feed roll includes (1) a movable rotary bearing supporting said feed roll and (2) a lever arm pivotally secured at a first end thereof; said lever arm having a second end carrying said rotary bearing; and (b) spring means for resiliently urging said feed roll and said feed lip towards one another; said spring means being connected to said lever arm.

13. In a fiber tuft feeder including a reserve chute having an outlet;

a feed roll supported in the reserve chute at the outlet thereof;

a feed lip stationarily affixed to said reserve chute and cooperating with the feed roll for defining therewith a nip through which the feed roll draws fiber tufts from the reserve chute;

an opening roll supported immediately downstream of the nip as viewed in a direction of passage of the fiber tufts through the nip; said opening roll being arranged for receiving fiber tufts from said nip; and a feed chute having an inlet connected to the outlet of the reserve chute; said feed chute being arranged for receiving fiber tufts from said opening roll; said feed chute further having an outlet for discharging fiber tufts from said feed chute;

the improvement comprising (a) means for movably supporting said feed roll for displacements toward and away from said feed lip for varying the distance between the feed roll and the feed lip by the fiber tufts passing therebetween;

(b) a low-friction coating covering said feed lip; and (c) spring means for resiliently urging said feed roll and said feed lip towards one another.

14. A fiber tuft feeder as defined in claim 13, wherein said coating comprises Teflon.

* * * * *